US009205949B2

(12) United States Patent
Liu et al.

(10) Patent No.: US 9,205,949 B2
(45) Date of Patent: Dec. 8, 2015

(54) FOLDING BOX

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventors: Hai Liu, Shenzhen (CN); Fu Liao, Shenzhen (CN); Guang-Long Li, Shenzhen (CN); Ming-Chang Lee, New Taipei (TW)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/468,060

(22) Filed: Aug. 25, 2014

(65) Prior Publication Data

US 2015/0060442 A1 Mar. 5, 2015

(30) Foreign Application Priority Data

Aug. 29, 2013 (CN) ..... 2013 1 3835982

(51) Int. Cl.
*B65D 6/18* (2006.01)

(52) U.S. Cl.
CPC ..... *B65D 11/1833* (2013.01)

(58) Field of Classification Search
CPC ..... B65D 19/02; B65D 11/1826
USPC ..... 220/6, 7, 4.29, 4.28; 206/386, 599, 600, 206/503
See application file for complete search history.

(56) References Cited

U.S. PATENT DOCUMENTS

| | | | | |
|---|---|---|---|---|
| 5,038,953 | A * | 8/1991 | Radar | 220/6 |
| 5,538,153 | A * | 7/1996 | Marovskis et al. | 220/6 |
| 6,405,888 | B1 * | 6/2002 | Overholt et al. | 220/6 |
| 6,722,515 | B2 * | 4/2004 | Rumpel | 220/6 |
| 7,159,730 | B2 * | 1/2007 | Rumpel | 220/7 |
| 7,195,127 | B2 * | 3/2007 | Hsu et al. | 220/6 |

* cited by examiner

*Primary Examiner* — Steven A. Reynolds
*Assistant Examiner* — King M Chu
(74) *Attorney, Agent, or Firm* — Novak Druce Connolly Bove + Quigg LLP

(57) ABSTRACT

A folding box includes a base, two side boards, and two end boards. The base includes a bottom plate, two side plates protruding up from opposite sides of the bottom plate, and two end plates protruding up from opposite ends of the bottom plate. Each side plate defines a number of first receiving slots. Each end plate defines a number of second receiving slots. A first shaft is mounted in each first receiving slot, and a second shaft is mounted in each second receiving slot. Each side board includes a number of first hooks protruding down from a bottom of the side board. Each end board includes a number of second hooks protruding down from a bottom of the end board.

9 Claims, 12 Drawing Sheets

FOLDING BOX

FIELD

The present disclosure relates to a folding box.

BACKGROUND

Goods are often stored in boxes for convenient classification and transportation. Assembly and disassembly of each box is often time-consuming and laborious.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The present disclosure, including the accompanying drawings, is illustrated by way of examples and not by way of limitation. It should be noted that references to "an" or "one" embodiment in this disclosure are not necessarily to the same embodiment, and such references mean "at least one."

Figure 1:
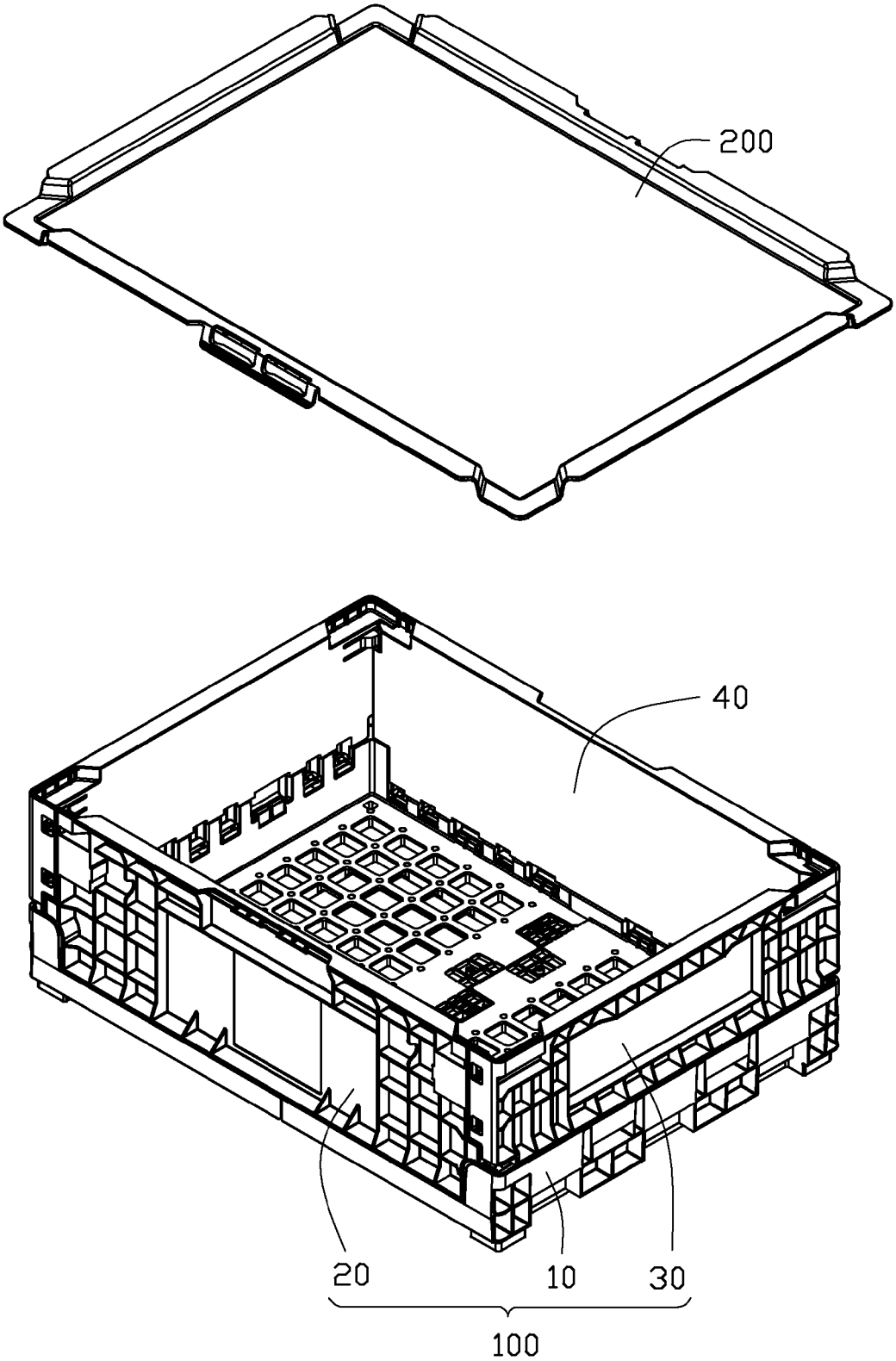
FIG. 1 is an isometric view of an embodiment of a folding box, wherein the folding box includes a base, two opposite side boards, and two opposite end boards.

FIG. 1 illustrates an embodiment of a folding box comprising a box 100 and a cover 200. The box 100 comprises a substantially rectangular base 10, two opposite side boards 20, and two opposite end boards 30. The base 10, the side boards 20, and the end boards 30 cooperatively bound a receiving space 40 for storing goods.

Figure 2:
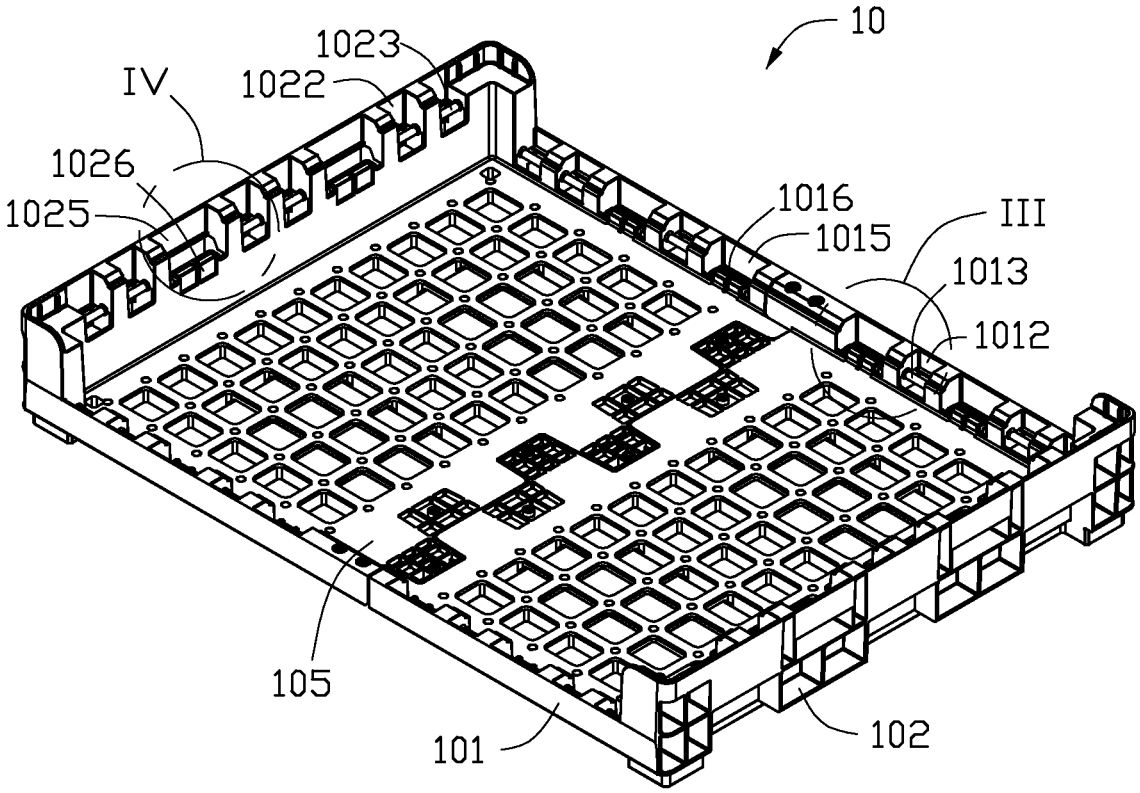
FIG. 2 is an enlarged view of the base of FIG. 1.
Figure 3:
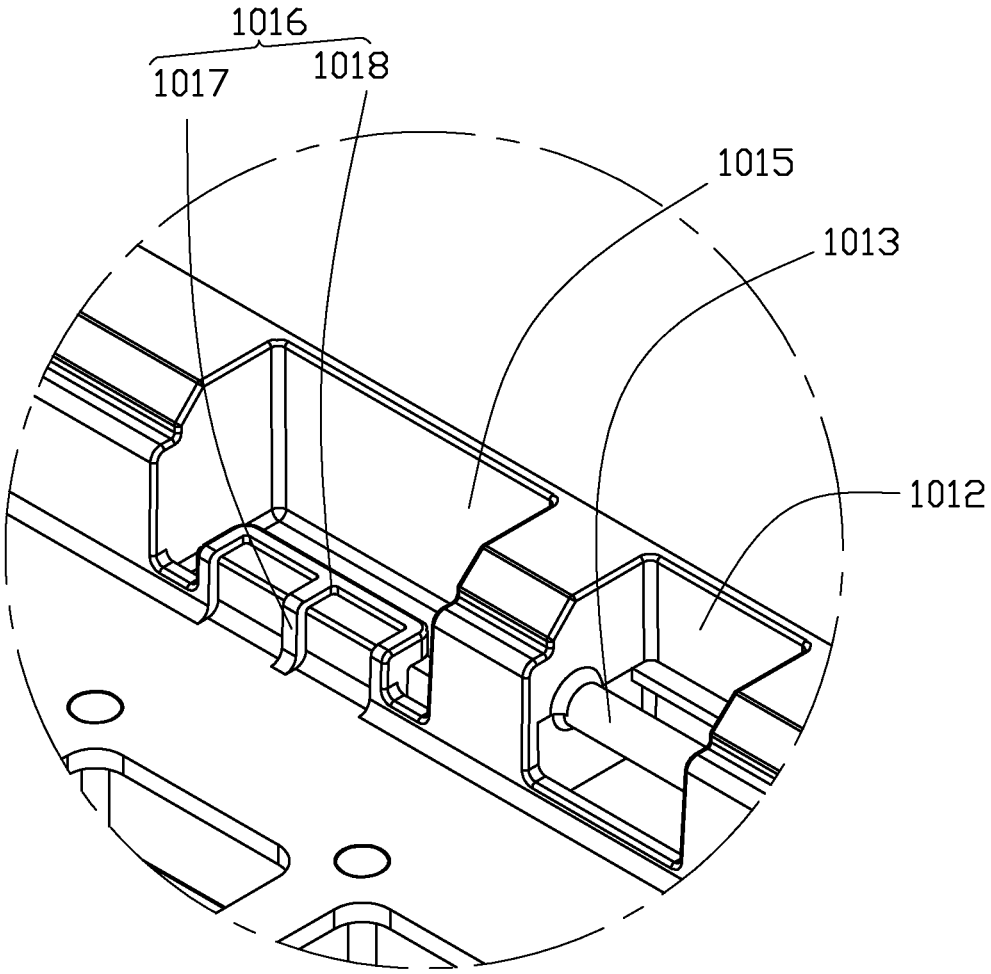
FIG. 3 is an enlarged view of a circled portion III of FIG. 2.
Figure 4:
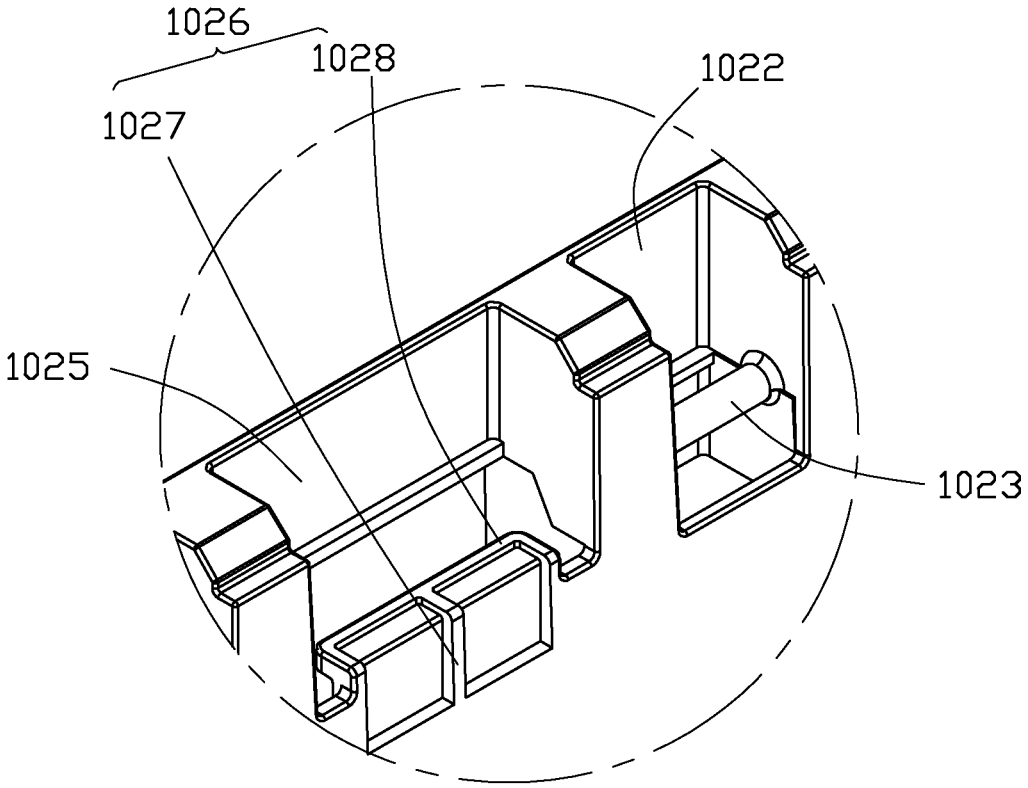
FIG. 4 is an enlarged view of a circled portion IV of FIG. 2.

FIGS. 2-4 illustrate that the base 10 comprises a substantially rectangular bottom plate 105, two side plates 101 substantially perpendicularly extending up from opposite sides of the bottom plate 105, and two end plates 102 substantially perpendicularly extending up from opposite ends of the bottom plate 105. The end plates 102 are higher than the side plates 101. Each side plate 101 defines a plurality of spaced receiving slots 1012, and each receiving slot 1012 extends through a top surface and an inner side of the corresponding side plate 101. A corresponding shaft 1013 is mounted and received in each receiving slot 1012. Each shaft 1013 is substantially parallel to a lengthwise direction of the side plates 101. Each end plate 102 defines a plurality of spaced receiving slots 1022, and each receiving slot 1022 extends through a top surface and an inner side of the corresponding end plate 102. A corresponding shaft 1023 is mounted and received in each receiving slot 1022. Each shaft 1023 is substantially parallel to a lengthwise direction of the end plates 102.

Each side plate 101 defines a plurality of spaced latching recesses 1015, and each latching recess 1015 extends through the top surface and the inner side of the corresponding side plate 101. A substantially L-shaped resilient latching piece 1016 protrudes from a bottom surface of each latching recess 1015, adjacent to an inner side of the corresponding side plate 101. The resilient latching piece 1016 comprises a resilient connecting portion 1017 substantially perpendicular to the bottom surface of the corresponding latching recess 1015, and a latching portion 1018 substantially perpendicularly extending from an end of the connecting portion 1017 toward an outer side of the corresponding side plate 101. Each end plate 102 defines a plurality of spaced latching recesses 1025, and each latching recess 1025 extends through a top surface and an inner side of the corresponding end plate 102. A substantially L-shaped resilient latching piece 1026 protrudes from a bottom surface of each latching recess 1025, adjacent to an inner side of the corresponding end plate 102. The resilient latching piece 1026 comprises a resilient connecting portion 1027 substantially perpendicular to the bottom surface of the corresponding latching recess 1025, and a latching portion 1028 substantially perpendicularly extending from an end of the connecting portion 1027 toward an outer side of the corresponding end plate 102.

Figure 5:
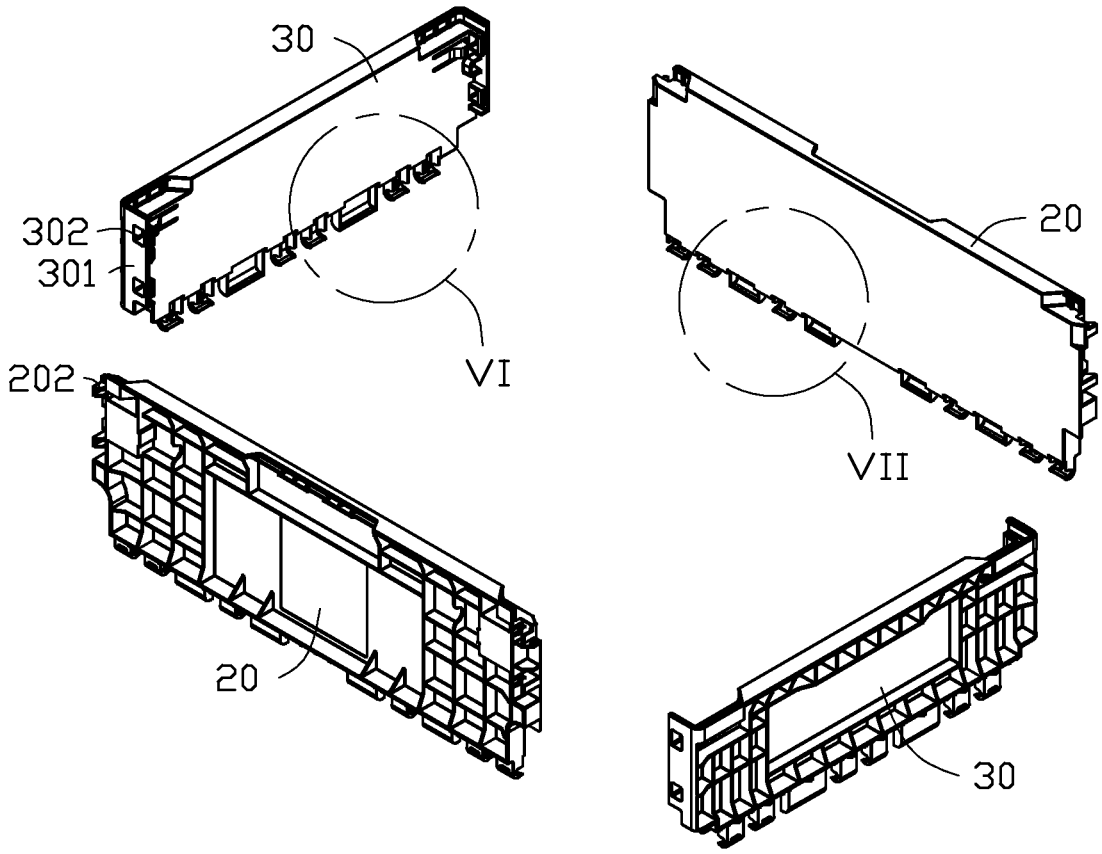
FIG. 5 is an exploded, isometric view of the side boards and the end boards of FIG. 1.
Figure 6:
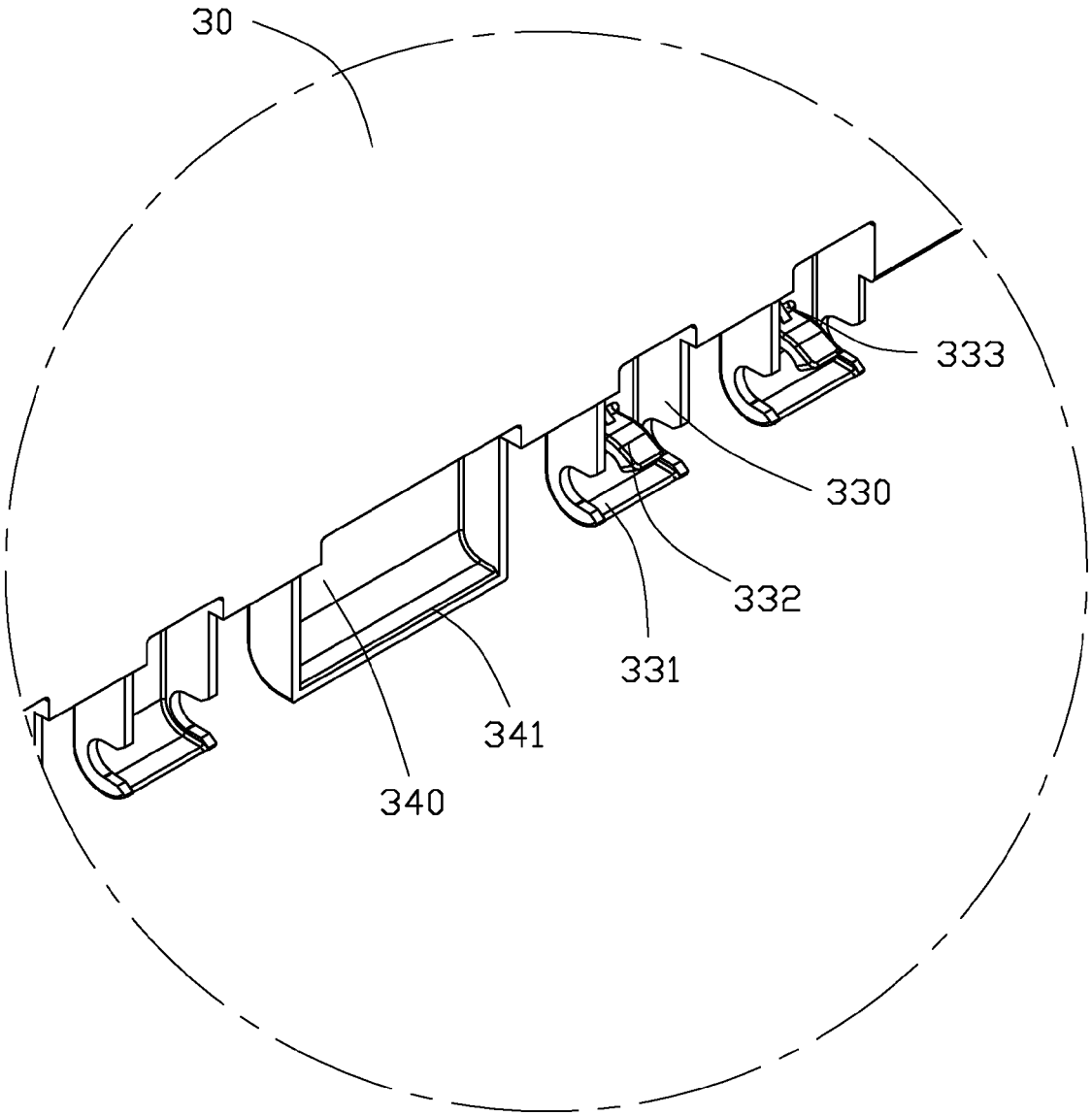
FIG. 6 is an enlarged view of a circled portion VI of FIG. 5.

Referring to FIG. 1, FIG. 5, and FIG. 6, each end board 30 is substantially rectangular, and a corresponding flange 301 substantially perpendicularly extends toward the receiving space 40 from each end of the end board 30. Each flange 301 defines two spaced positioning holes 302. A plurality of resilient hooks 330 protrudes down from a bottom of each end board 30. The hooks 330 are arrayed along a lengthwise direction of the corresponding end board 30. Each hook 330 comprises a substantially C-shaped resilient rotating portion 331 slantingly extending toward the receiving space 40. A resilient arcuate tab 332 extends toward the receiving space 40 and the corresponding rotating portion 331 from each hook 330. The tab 332 is located above the corresponding rotating portion 331. A reinforcing rib 333 protrudes from each hook 330 and is connected to a top of the corresponding tab 332. A plurality of spaced positioning portions 340 protrudes down from the bottom of each end board 30. The positioning portions 340 are arrayed along the lengthwise direction of the corresponding end board 30. Each positioning portion 340 comprises an arcuate positioning piece 341 slantingly extending toward the receiving space 40 from a bottom of the positioning portion 340.

Figure 7:
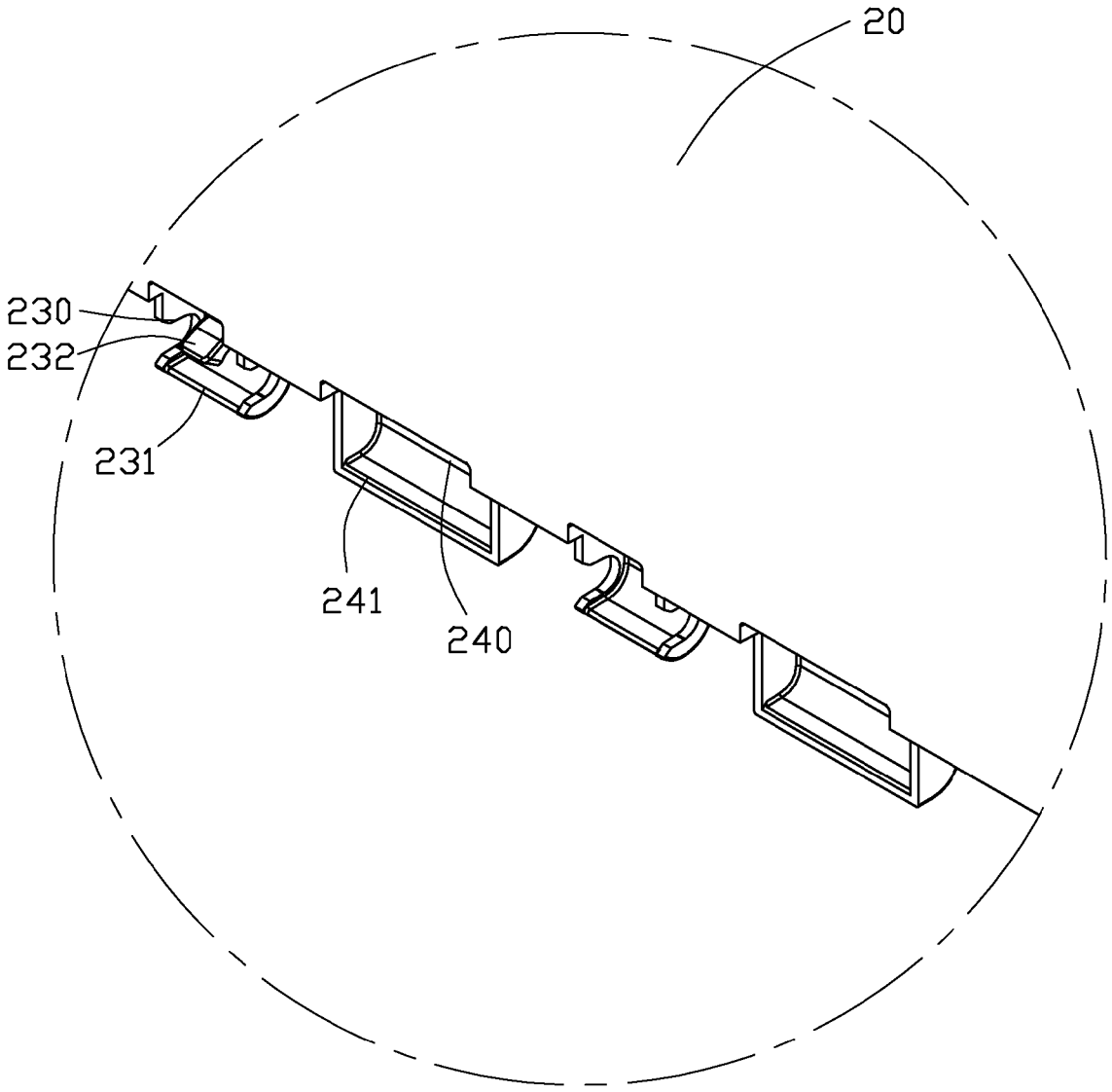
FIG. 7 is an enlarged view of a circled portion VII of FIG. 5.

Referring to FIG. 5 and FIG. 7, each side board 20 is substantially rectangular, and two corresponding spaced latching blocks 202 protrude out from each end of each side board 20. A plurality of resilient hooks 230 protrudes down from a bottom of each side board 20. The hooks 230 are arrayed along a lengthwise direction of the corresponding side board 20. Each hook 230 comprises a substantially C-shaped resilient rotating portion 231 slantingly extending toward the receiving space 40. A resilient arcuate tab 232 extends toward the receiving space 40 and the corresponding rotating portion 231 from each hook 230. The tab 232 is located above the corresponding rotating portion 231. A reinforcing rib protrudes inward from each hook 230 and is connected to a top of the corresponding tab 232. A plurality of spaced positioning portions 240 protrudes down from the bottom of each side board 20. The positioning portions 240 are arrayed along the lengthwise direction of the corresponding side board 20. Each positioning portion 240 comprises an arcuate positioning piece 241 slantingly extending toward the receiving space 40 from a bottom of the positioning portion 240.

Figure 8:
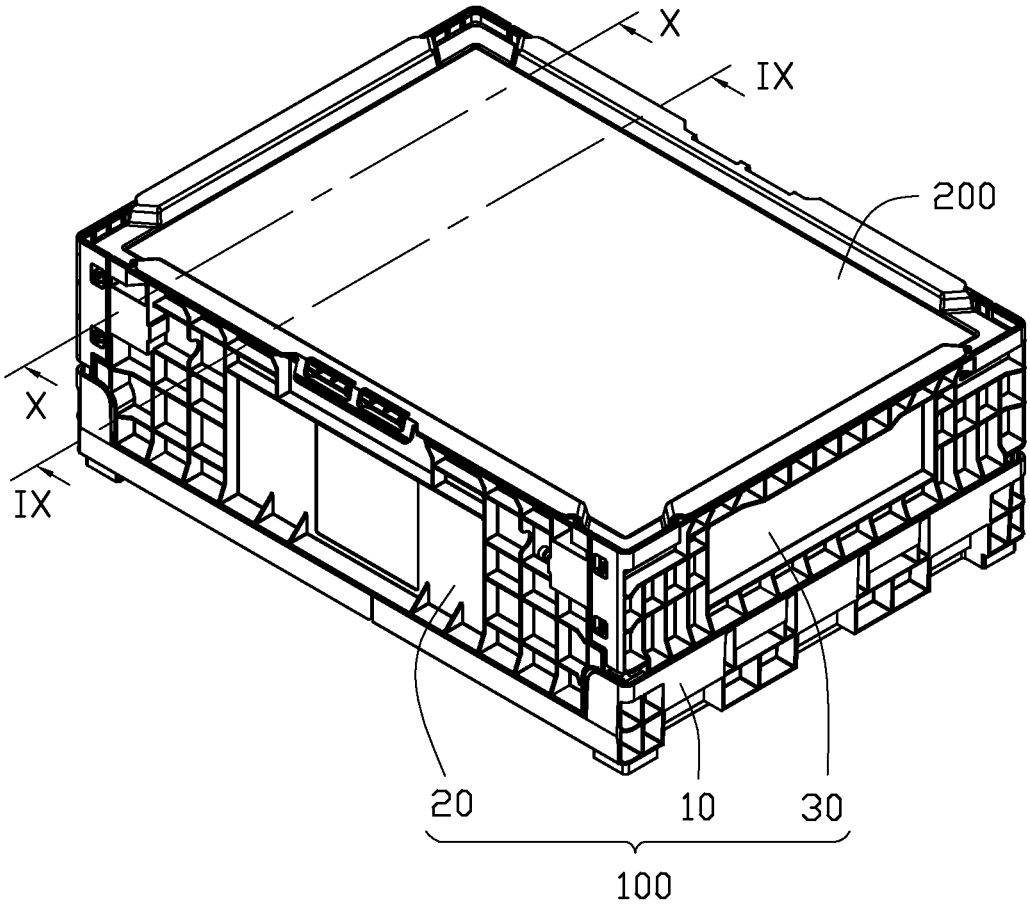
FIG. 8 is an assembled view of FIG. 1.
Figure 9:
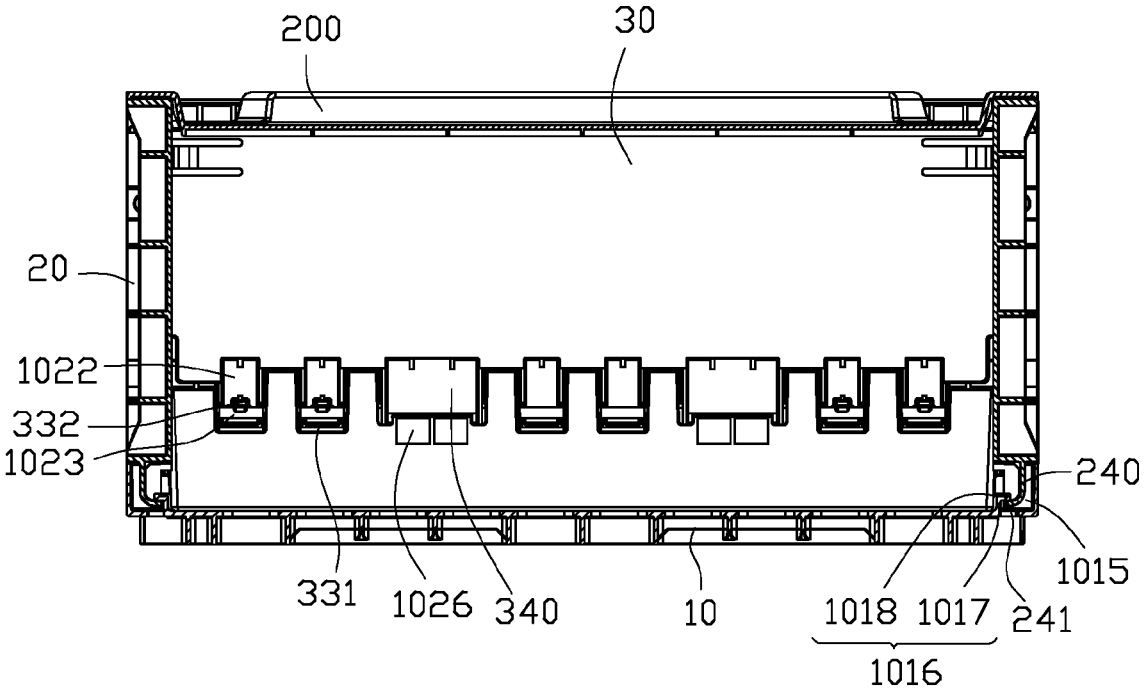
FIG. 9 is a cross-sectional view of FIG. 8, taken along line IX-IX.
Figure 10:
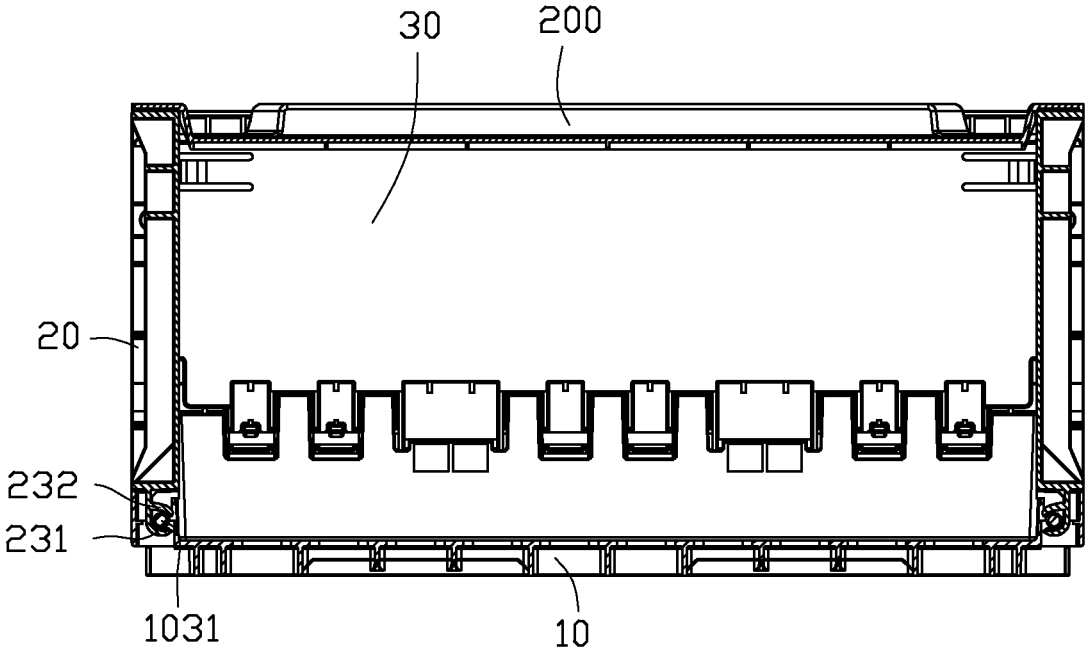
FIG. 10 is a cross-sectional view of FIG. 8, taken along line X-X.

FIGS. 8-10 illustrate that assembled states of the folding box. The hooks 230 of each side board 20 are received in the corresponding receiving slots 1012, and the positioning portions 240 are received in the corresponding latching recesses 1015. Each side board 20 is pressed toward the base 10. Each shaft 1013 resists against and deforms the corresponding rotating portion 231 and the corresponding tab 232, to be received between the corresponding rotating portion 231 and the corresponding tab 232. The rotating portions 231 and the tabs 232 are restored to latch the shafts 1013. The positioning portions 240 are inserted into the corresponding latching recesses 1015, deforming the latching piece 1016 until each positioning piece 241 is located below the latching portion 1018 of the corresponding latching piece 1016. The latching pieces 1016 are restored to bias the latching portions 1018 to latch the positioning pieces 241. Thus, each side board 20 can be rotated about the corresponding shafts 1013.

The hooks 330 of each end board 30 are received in the corresponding receiving slots 1022, and the positioning portions 340 are received in the corresponding latching recesses 1025. Each end board 30 is pressed toward the base 10. Each shaft 1023 resists against and deforms the corresponding rotating portion 331 and the corresponding tab 332, to be received between the corresponding rotating portion 331 and the corresponding tab 332. The rotating portions 331 and the tabs 332 are restored to latch the shafts 1023. The positioning portions 340 are inserted into the corresponding latching recesses 1025, deforming the latching pieces 1026 until each positioning piece 341 is located below the latching portion 1028 of the corresponding latching piece 1026. The latching pieces 1026 are restored to bias the latching portions 1028 to latch the positioning pieces 341. Thus, each end board 30 can be rotated about the corresponding shafts 1023.

The end boards 30 are rotated away from the base 10 about the corresponding shafts 1023, until the end boards 30 are substantially perpendicular to the base 10. The side boards 20 are rotated away from the base 10 about the corresponding shafts 1013, until the side boards 20 are substantially perpendicular to the base 10. The latching blocks 202 are latched in the corresponding position holes 302. The latching portions 1018 and 1028 latch the positioning pieces 241 and 341 of the corresponding positioning portions 240 and 340. Thus, the receiving space 40 is bounded by the base 10, the side boards 20, and the end boards 30. The cover 200 is covered on a top of the box 100.

Figure 11:
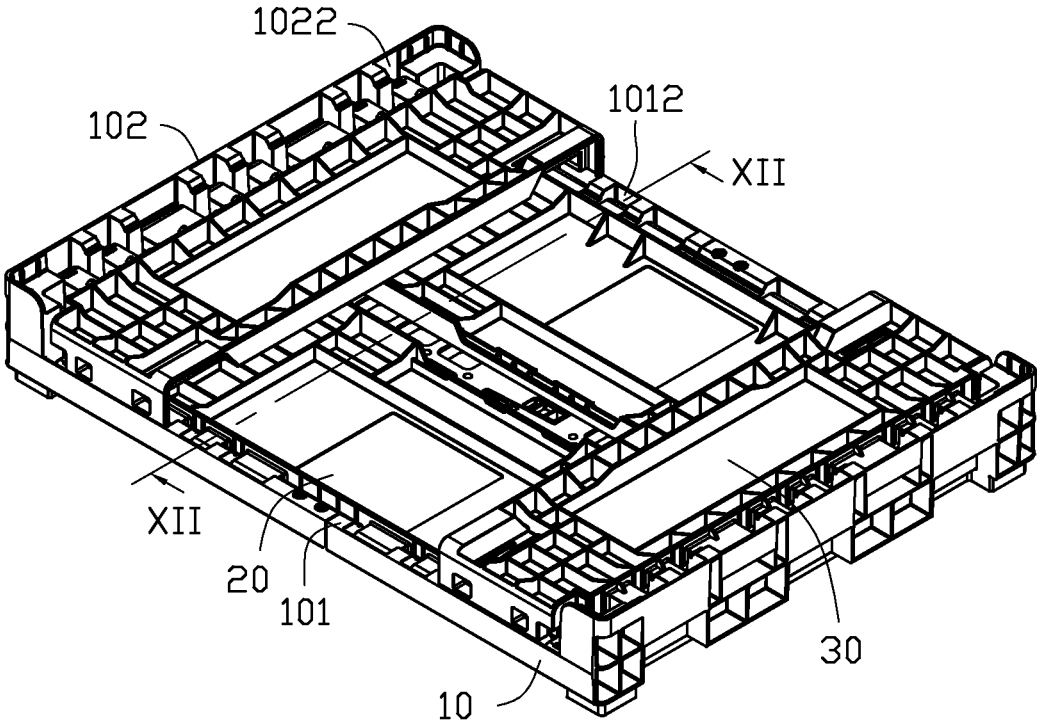
FIG. 11 is an assembled, isometric view of FIG. 1, but showing the folding box in a folded state.
Figure 12:
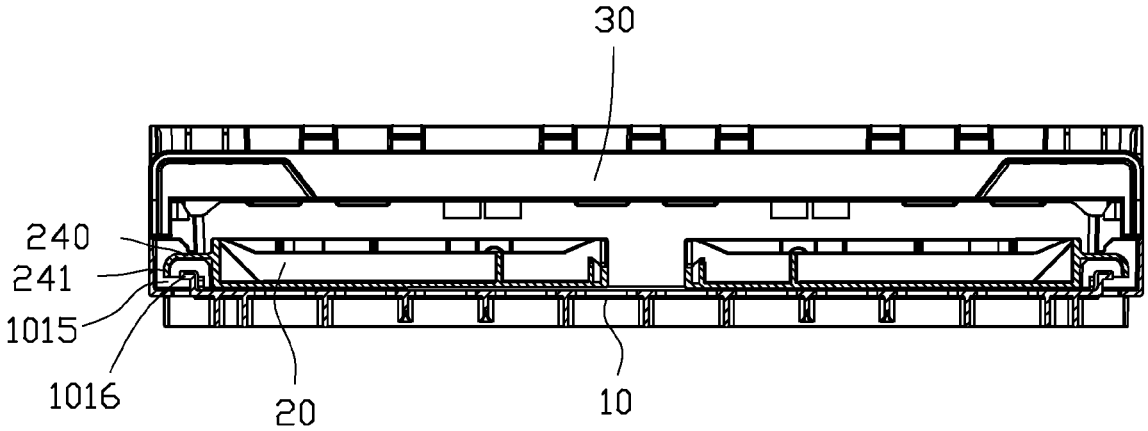
FIG. 12 is a cross-sectional view of FIG. 11, taken along line XII-XII.

Referring to FIG. 11 and FIG. 12, when folding the folding box, the cover 200 is detached from the box 100. The side boards 20 are rotated toward the base 10, such that the latching blocks 202 are detached from the corresponding positioning holes 302, until the side boards 20 are supported on the base 10 and the positioning pieces 241 are detached from the latching portions 1018. The end boards 30 are rotated toward the base 10, until the end boards 30 are supported on the side boards 20, and the positioning pieces 341 are detached from the latching portions 1028. Thus, the folding box is folded.

The side boards 20 and the end boards 30 can be rotated relative to the base 10, and each end board 30 can be detachably latched to the side boards 20. Thus, assembly and disassembly of the folding box is convenient. When the side boards 20 are substantially perpendicular to the base 10, the positioning pieces 241 are latched below the latching pieces 1016 for preventing the hooks 230 from detaching from the shafts 1013. When the end boards 30 are substantially perpendicular to the base 10, the positioning pieces 341 are latched below the latching pieces 1026 for preventing the hooks 330 from detaching from the shafts 1023.

Even though numerous characteristics and advantages of the embodiments have been set forth in the foregoing description, together with details of the structure and function of the embodiments, the present disclosure is illustrative only, and changes may be made in detail, including in the matters of shape, size, and arrangement of parts within the principles of the embodiments to the full extent indicated by the broad general meaning of the terms in which the appended claims are expressed.

What is claimed is:

1. A folding box, comprising:

a base comprising a substantially rectangular bottom plate, two side plates protruding up from two opposite sides of the bottom plate, and two end plates protruding up from two opposite ends of the bottom plate; wherein each side plate defines a plurality of first receiving slots, each end plates defines a plurality of second receiving slots, a first shaft is mounted in each first receiving slot, a second shaft is mounted in each second receiving slot, the first shafts are parallel to a lengthwise direction of the side plates, and the second shafts are parallel to a lengthwise direction of the end plates;

two side boards each comprising a plurality of first hooks protruding down from a bottom of the side board; and two end boards each comprising a plurality of second hooks protruding down from a bottom of the end board;

wherein the first hooks of the side boards are received in the first receiving slots of the base and are rotatably connected to the first shafts, the second hooks of the end boards are received in the second receiving slots of the base and are rotatably connected to the second shafts, two opposite ends of each side board are detachably latched to the end board;

wherein each side plate defines a plurality of latching recesses and a resilient latching piece protrudes up from a bottom surface of each latching recess, each side board comprises a plurality of positioning portions protruding down from the bottom of the side board, and the latching pieces are detachably latched to the positioning portions.

2. The folding box of claim 1, wherein each first hook comprises a C-shaped rotating portion, and a resilient arc-shaped tab extending toward the rotating portion from the first hook, each first shaft is rotatably sandwiched between the rotating portion and the tab of the corresponding first hook.

3. The folding box of claim 1, wherein each second hook comprises a C-shaped rotating portion, and a resilient arc-shaped tab extending toward the rotating portion from the second hook, each second shaft is rotatably sandwiched between the rotating portion and the tab of the corresponding second hook.

4. The folding box of claim 1, wherein each first receiving slot extends through an inner side and a top surface of the corresponding side plate, each second receiving slot extends through an inner side and a top surface of the corresponding end plate.

5. The folding box of claim 1, wherein the positioning portions are received in the lathing slot.

6. The folding box of claim 1, wherein each positioning portion comprises an arc-shaped positioning piece extending inward from a bottom of the positioning portion, each latching piece comprises a connecting portion extending up from the bottom surface of the corresponding latching recess, and a latching portion extending from a distal end of the connecting portion toward an outer side of the corresponding side plate, the positioning pieces are latched below the latching portions for avoiding the shafts detaching from the hooks.

7. The folding box of claim 1, wherein each end plate defines a plurality of latching recesses, a resilient latching piece protrudes up from a bottom surface of each latching recess, each end board comprises a plurality of positioning portions protruding down from the bottom of the end board, the positioning portions are received in the lathing slot, and the latching pieces are detachably latched to the positioning portions.

8. The folding box of claim 7, wherein each positioning portion comprises an arc-shaped positioning piece extending inward from a bottom of the positioning portion, each latching piece comprises a connecting portion extending up from the bottom surface of the corresponding latching recess, and a latching portion extending from a distal end of the connecting portion toward an outer side of the corresponding side plate, the positioning pieces are latched below the latching portions for avoiding the shafts detaching from the hooks.

9. The folding box of claim 1, wherein each end board comprises two flanges extending inward from two opposite ends of the end board, each flange defines a positioning hole, each side board comprises two latching blocks protruding out from two opposite ends of the side board, each latching block is detachably latched in the corresponding positioning hole.

* * * * *